US005394628A

United States Patent [19]

DeMarchi

[11] Patent Number: 5,394,628

[45] Date of Patent: Mar. 7, 1995

[54] ALPINE SKI BOOT WITH AN ENERGY FLAP JOURNALLED ON THE SHELL BASE

[75] Inventor: Jean-Louis DeMarchi, Saint-Jorioz, France

[73] Assignee: Salomon S.A., Annecy Cedex, France

[21] Appl. No.: 854,860

[22] Filed: Mar. 20, 1992

[30] Foreign Application Priority Data

Mar. 21, 1991 [FR] France ..... 91 03669

[51] Int. Cl.[6] ..... A43B 5/04

[52] U.S. Cl. ..... 36/121; 36/120

[58] Field of Search ..... 36/119–121, 36/117, 118

[56] References Cited

U.S. PATENT DOCUMENTS

| | | | |
|---|---|---|---|
| 3,419,974 | 1/1969 | Lange | 36/119 X |
| 3,619,914 | 11/1971 | Hanson et al. | 36/121 |
| 3,713,231 | 1/1973 | Mochizuki | 36/121 |
| 3,883,964 | 5/1975 | Check | 36/119 |
| 4,060,256 | 11/1977 | Collombin et al. | 280/613 |
| 4,078,322 | 3/1978 | Dalebout | 36/121 |
| 4,085,528 | 4/1978 | Delery | 36/121 |
| 4,095,356 | 6/1978 | Robran et al. | 36/121 |
| 4,494,324 | 1/1985 | Spademan | 36/119 |
| 4,499,676 | 2/1985 | Chalmers, II | 36/120 |
| 4,565,017 | 1/1986 | Ottieri | 36/117 |
| 4,615,127 | 10/1986 | Delery | 36/121 X |
| 4,669,202 | 6/1987 | Ottieri | 36/120 |
| 4,691,454 | 9/1987 | Ottieri | 36/117 |
| 4,759,137 | 7/1988 | Lederer | 36/120 X |
| 4,839,973 | 6/1989 | Dodge | 36/119 X |
| 4,882,857 | 11/1989 | Sartor et al. | 36/120 |
| 4,887,370 | 12/1989 | Okada | 36/120 |
| 4,897,940 | 2/1990 | Sartor | 36/121 X |
| 4,905,385 | 3/1990 | Perrissoud | 36/120 |
| 4,907,354 | 3/1990 | Benoit et al. | 36/119 |
| 4,962,594 | 10/1990 | Marega et al. | 36/117 |
| 5,031,341 | 7/1991 | Paris et al. | 36/121 |
| 5,060,403 | 10/1991 | Battistella et al. | 36/119 |

FOREIGN PATENT DOCUMENTS

| | | | |
|---|---|---|---|
| 177269 | 1/1986 | European Pat. Off. | A43B 5/04 |
| 350023 | 1/1990 | European Pat. Off. | A43B 5/04 |
| 380444 | 8/1990 | European Pat. Off. | A43B 5/04 |
| 2096248 | 2/1972 | France | A43B 5/00 |
| 2305948 | 10/1976 | France | A43B 5/04 |
| 2330346 | 6/1977 | France | A43B 5/04 |
| 2619684 | 3/1989 | France | A43B 5/04 |
| 3530243 | 3/1987 | Germany | A43B 5/04 |
| 375526 | 4/1964 | Switzerland . | |
| 491619 | 7/1970 | Switzerland | A43B 5/04 |
| 512204 | 10/1971 | Switzerland | A43B 5/04 |

*Primary Examiner*—Paul T. Sewell
*Assistant Examiner*—Ted Kavanaugh
*Attorney, Agent, or Firm*—Sandler, Greenblum & Bernstein

[57] ABSTRACT

A ski boot having a shell surmounted by an upper having a rear opening for passage of the foot, and at least one tightening system of the upper on the lower part of the leg, a flexion control device both of amplitude and force of the upper in the frontward direction being located at the rear of the boot. The flexion control device includes an energy flap affixed to the shell base on which it is journalled via a hinge, the flap including a movable abutment constituted by its edges, capable of cooperating with a fixed abutment of the shell base from a position corresponding to the start of the flexion control.

18 Claims, 5 Drawing Sheets

ALPINE SKI BOOT WITH AN ENERGY FLAP JOURNALLED ON THE SHELL BASE

BACKGROUND OF THE INVENTION

1. Field of the Invention

The present invention relates to an alpine ski boot having at least one rear portion of the upper that is retractable towards the rear for introducing and/or extracting the foot of the skier and relates to the implementation of the flexion control means of the upper arranged at the rear of such a boot in the zone of the rear portion of the upper.

2. Description of Background and Relevant Information

This type of boot usually comprises a shell base surmounted by an upper at least partially journalled on the latter, for example, about a transverse axis, the upper comprising at least one front portion and one rear portion adapted to be separated from one another in the open position for passage of the foot. In these boots, at least one tightening system at least partially encircles the front and rear portions of the upper and is associated to at least one of the portions for maintaining these latter portions against the lower part of the leg of the skier in the skiing position.

Insofar as the flexion control means of the upper are concerned, various embodiments have been suggested. Most often, these means are constituted by springs or other elastically deformable elements positioned between the shell base and the rear portion of the upper that they connect to each other. These means generally project on a large zone of the rear portion of the upper and necessitate the implementation of numerous linking elements such as anchoring elements in the shell base and the upper, and guide and position maintenance elements for the springs adapted to intervene especially during flexion movements of the upper.

As examples, ski boots are illustrated in U.S. Pat. No. 3,619,914 and Swiss Patent Nos. 491,619 and 512,204, where such flexion control means are disclosed. As is clear from these documents, these flexion control means are complex and basically adapted for ski boots of the "top entry" type, due to the fact that they form a connection bridge between the lower shell and the rear part of the upper. Indeed, only this type of top entry alpine ski boot, that is provided with at least one upper opening-located on the front portion of the upper and/or the shell base, enables introduction of the foot in the boot without necessitating the disengagement or removal of the rear portion of the upper towards the rear.

Further, ski boots disclosed in the French Patent Publication Nos. 2,305,948 and 2,330,345 include flexion control means that are relatively flexible reinforcements, whose volume is almost entirely integrated to the rear portion of the upper. Such an embodiment of the means enables the construction of boots that are comparatively lacking in raised portions and/or projections on the outside of the shell, in comparison with those cited previously, and this especially enables a more rational use of the boots with ski clothes that normally cover the top of the upper of the boots. It remains, however, that such means cannot always be adapted to ski boots of the rear entry and/or the mixed entry type.

Indeed, to retain the boot structure for rear entry alpine ski boots, provided with a flexion control device of the upper which does not project on the rear portion of the upper, the most common solution has been to shift the elastic means from the rear portion of the upper to the front portion of this upper. A great number of boots have been manufactured according to such a structure, and we can cite for example, the boots taught in the French Patent Publication No. 2,096,248 and U.S. Pat. No. 4,095,356.

In French Patent Publication No. 2,096,248, the rear entry boot has a rear portion of the upper that is journalled on an axis of the shell base, and that achieves a blocking of the opening between the upper and the shell base at the level of the heel. A flap stirrup attached on one or the other of these elements fulfills the role of a closure element limited to the heel zone. In such a device, the control and limitation of flexion of the upper are only obtained by the elastic means arranged at the front of the boot, between the front portion of the upper and a front upper portion of the shell base.

U.S. Pat. No. 4,095,356 also discloses a rear entry type of ski boot, in which the front portion of the upper is journalled about a first axis corresponding substantially to the malleoli, the front portion comprising an extension towards the base bearing a second axis on which the rear portion of the upper is capable of pivoting with respect to the front portion. In flexion, the front spoiler rear spoiler assembly pivots about the first axis.

In the same way as described previously, the journalled flap represented closes shuts an opening limited between the rear portion of the upper and the shell base, but does not play any role in the flexion control of the upper, which role is fulfilled by a joint positioned between the lower front edge of the front portion of the upper and the upper front edge of the shell base.

It is clear that the boots mentioned above in French Patent Publication No. 2,096,248 and U.S. Pat. No. 4,095,356 enable an easy entry into the boot from the rear due to the fact that the flexion control means have been shifted to the front of the upper. However, this arrangement of the control means at the front has some disadvantages when used, because the resisting forces of the means are localized on the front surface of the lower part of the leg of the skier, that is, contacting the bony portions of the latter which are the least protected. The result is that these bony portions are sensitized to a lesser or greater degree, and this results in irritation, even the formation of callouses, which, at the very least, adversely affect the comfort of the skier.

It is especially for this reason that it was estimated that a retention of the upper at the rear, by means of an upper assembly forming a collar, would have the effect of distributing the forces along the entire perimeter of the lower part of the leg, without any localized support or force.

SUMMARY OF THE INVENTION

The instant invention specifically aims to achieve this result, and is related, to this end, to alpine ski boots comprising a rigid shell, whose shell base is surmounted by an upper having at least one front portion and one rear portion, the upper being at least partially journalled on the latter, and itself comprising a rear opening to enable passage of the foot, a closure assembly forming a collar on the lower part of the leg, comprising at least one tightening system at least partially enclosing the upper in order to be tensioned by at least one tensioning element, such as a lever fixed on one of the component parts of the upper, and flexion control means of the upper, both of amplitude and of force in a frontward direction, being located at the rear of the boot, wherein the flexion control means of the amplitude and force in a frontward direction comprises a flexible flap constituting the energy source of the control means, the flap being affixed to the shell base at the zone of the heel in a journalled manner with respect to it, and capable of being pivotably driven by the rear portion of the upper with respect to the shell base in a rear-to-front movement, along a path demarcated from a fixed abutment zone, arranged on a portion of the shell base, and adapted to cooperate with a complementary movable abutment zone of the energy flap when the upper is closed on the lower part of the leg of the skier in the skiing position.

Such an energy flap indeed fulfills, in the present case, the role of a control element in front flexion, enabling specific control of the rocking of the upper towards the front, by virtue of a choice of shapes and materials that can also be implemented.

Moreover, by virtue of the small volume of the energy flap that extends in a contiguous manner beneath the rear portion of the upper, the choice of an appropriate material, although more expensive, does not adversely affect the manufacturing costs of the ski boot.

BRIEF DESCRIPTION OF THE DRAWINGS

Other characteristics and advantages of the invention will become more apparent upon reading the description that follows, given as non-limiting examples, and will enable one to better understand how the invention is implemented in light of the annexed drawings in which.

DETAILED DESCRIPTION OF THE PREFERRED EMBODIMENTS

Figure 1:
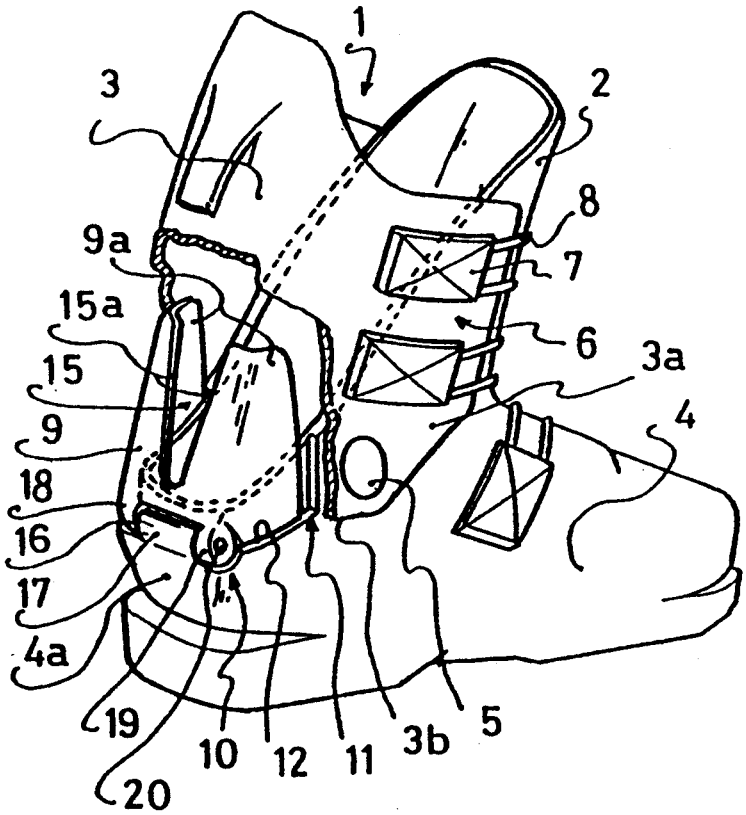
FIG. 1 is a perspective view of a ski boot, in a partial section, provided with flexion control means according to the invention.

As a representative, though non-limiting example only, the boot represented in FIGS. 1–4 is of the rear entry and/or the mixed entry type.

According to the invention, the ski boot has an upper 1 comprising at least one front portion 2 and one rear portion 3, and a shell base 4 on which upper 1 is journalled by means of a pair of laterally oppositely disposed connection elements, such as rivets or axles 5, along a transverse axis.

The boot represented also comprises several tightening and closure devices 6 of upper 1 on the lower part of the leg of a skier, each comprising, in a known manner, a tensioning lever 7 that fastens by tension, a flexible connection such as a buckle cable 8, partially encircling the front portion 2 of upper 1 so as to link each tensioning element 7, fixed on a wing 3*a* of the rear portion 3 to anchoring points (non-represented) arranged on the other wing 3*a* of the same portion 3, encircling in its passage, the front portion 2, in order to bring them closer together.

According to the invention, the boot comprises flexion control means of the amplitude of movement and magnitude of force of upper 1 in a frontward direction, and these are arranged at the rear of the boot.

These means comprise a flexible stirrup or flap 9 constituting the energy source, in the shape of an enveloping shell of the rear of the heel, affixed to the shell base 4 in the heel zone and comprising two lateral wings 9*a*, overlapped by the two lateral wings 3*a* of the rear portion 3 of upper 1 against which the flap 9 is maintained pressed in order that the latter may be driven by pivoting with respect to the shell base 4, in a rear-to-front or front-to-rear movement about a journal 10 arranged in a transverse manner between a lower portion of flap 9 and an upper portion of shell base 4, at the level of the heel, on which it is capable of being journalled, as shown in FIG. 1.

Figure 3:
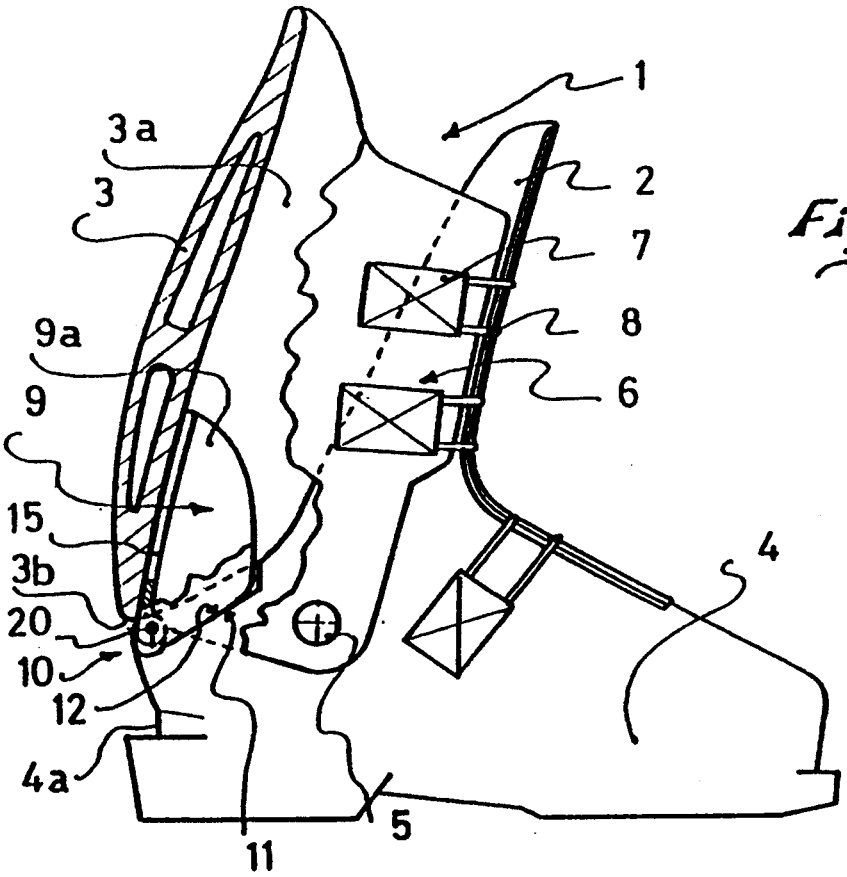

In a rear-to-front movement, when upper 1 is closed on the lower part of the leg of the skier, as shown in FIG. 3, the energy flap 9 is capable of being driven by pivoting by rear portion 3, along a certain free pivotal path limited towards the front, i.e., at a forwardmost point of the path, by a fixed abutment 11, arranged on an upper portion of the shell base 4. The abutment 11 thus cooperates with a complementary movable abutment 12 of the energy flap 9. From this position, the flexion control of the upper 1, occurring in the direction F1, is done by the reaction of flap 9 in the inverse direction F2 against the rear portion 3 of upper 1, as shown in FIG. 4, as the flap is moved along a flexional path forwardly of the free pivotal path.

Figure 2:
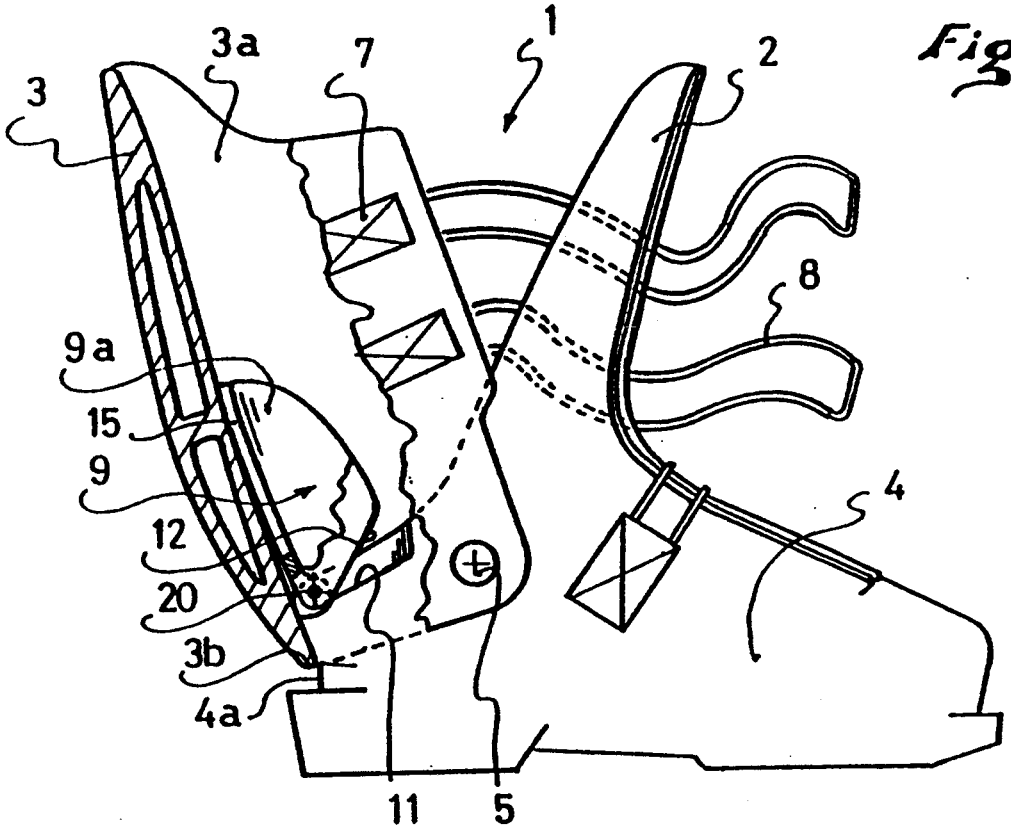
FIGS. 2, 3, and 4 are side views and partial sections of the boot according to FIG. 1, respectively illustrating the boot in an open position, a closed position and in a position of front flexion.

The energy flap 9 is also capable of pivoting in a front-to-rear direction along a path whose amplitude is respectively demarcated, on the one hand, by a fixed upper abutment 11 of shell base 4 defined previously, and, on the other hand, by a second lower fixed abutment zone 4*a*, constituted by a rear lower portion of the heel of the shell base 4, on which a lower zone 3*b* of the rear portion of upper 1 is capable of taking support, in a position of maximum opening for introduction of the foot, as shown in FIG. 2.

Figure 4:
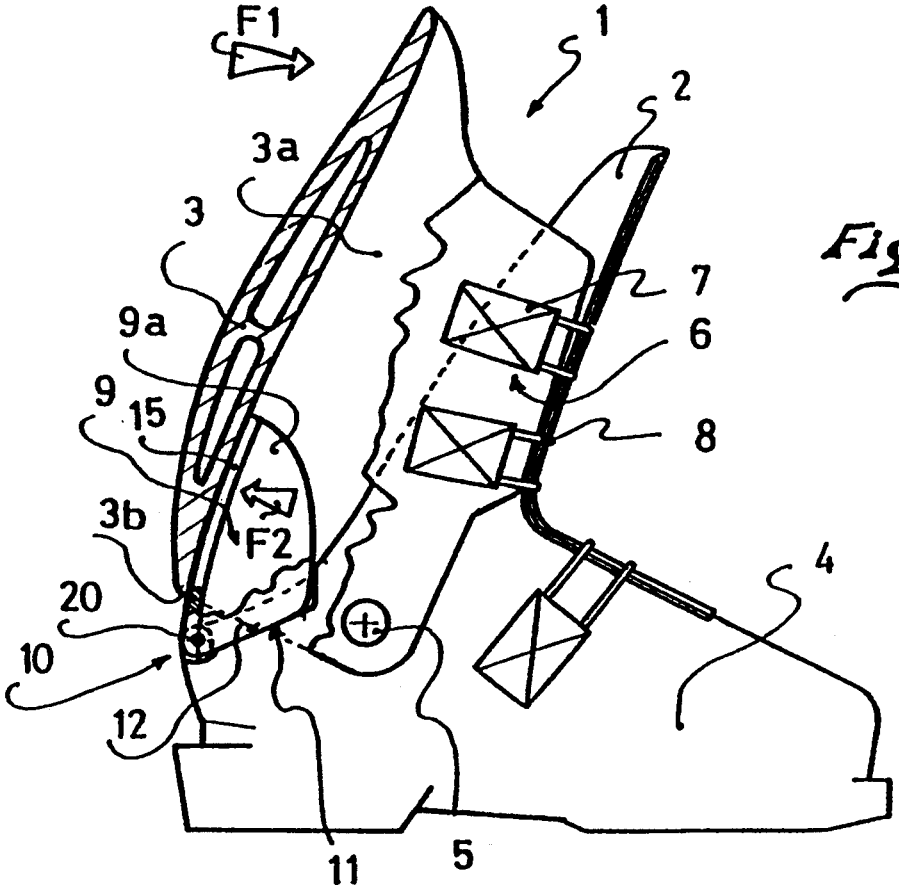

According to the embodiment represented in FIGS. 1–4, the movable abutment zone 12 of energy flap 9 is constituted by the edges of its own wings 9*a*, as a matter of fact their respective lower edges, adapted to cooperate with the fixed upper abutment 11 of shell base 4, the abutment 11 is itself constituted by two shoulders, obtained on both sides of shell base 4, and contacting the lower edges of wings 9*a* of energy flap 9 to enable the latter to take support in flexion, as shown in FIG. 4.

The energy flap 9 also comprises at its rear portion substantially in its median zone, a vertical scallop 15, opened in a flared manner upwardly, in this example, adapted to become deformed by the coming together of the lips of the edge 15*a* during front flexion.

Scallop 15 is directed in the opposite direction with respect to the journal means 10 of stirrup 9. From the instant at which the rear portion 3 biases stirrup 9 in front flexion, the latter, which is blocked during pivoting towards the front, on the upper abutment 11 of shell base 4, produces a resisting force by becoming elastically deformed by the simultaneous coming together of lips 15*a* of scallop 15 and by the buckling of these elements.

In the example chosen and represented in FIGS. 1–4, energy flap 9 is journalled at 10 on shell base 4 by means of a hinge 16 formed by a male element 17, obtained in molding with shell base 4, which is inserted in a female portion obtained on flap 9 at its lower portion, and demarcated by two lugs 18, 19, one pin 20 passing through both lugs 18, 19 and the male element 17 simultaneously.

Figure 9:
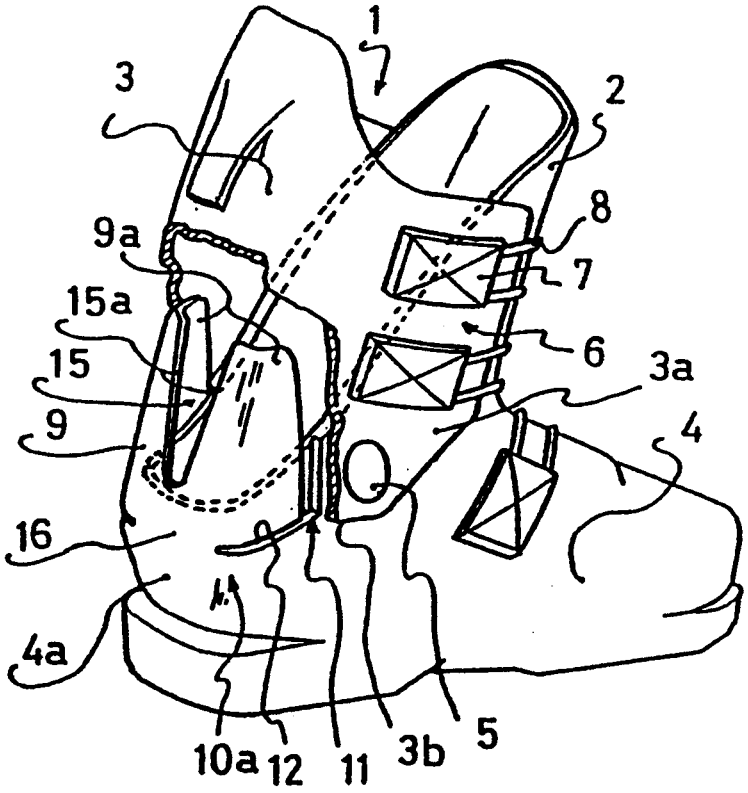
FIG. 9 represents a variation of the embodiment shown in FIG. 1.

Of course, journal 10 may be of any other type as for example a hinge constituted of a flexible element or area 10*a*, as shown in FIG. 9, obtained simultaneously with shell base 4 and the energy flap 9 during molding.

It is understood that in the embodiment of the journal in the shape of a hinge 16 described previously, energy flap 9 is obtained alone, independently of the other component parts of the boot, and thus may be advantageously manufactured, in an integral manner by molding of a plastic material selected for its mechanical characteristics, especially its flexibility.

Figure 5:
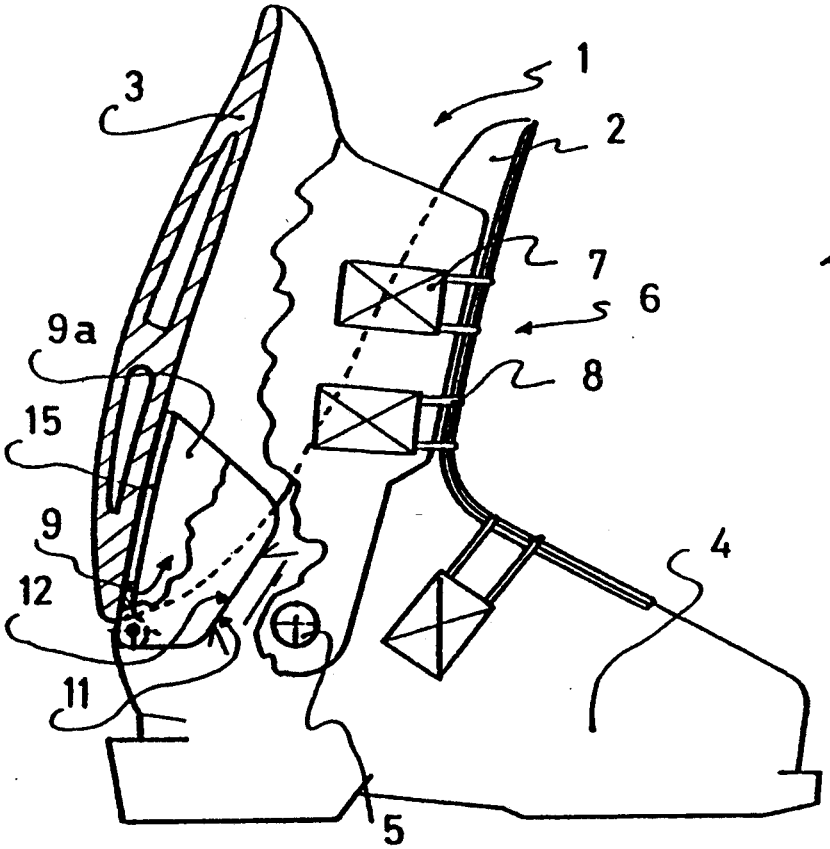
FIG. 5 shows a ski boot of the same type as that in FIG. 1, but in which the flexion control means operate differently.

In the ski boot represented in FIG. 5 that follows, the energy flap 9 is arranged in the same way as in the previous example of FIGS. 1–4 but its movable abutment zone 12 is, in this example, constituted by the vertical or upwardly extending edges of its wings 9*a*, instead of the horizontal edges, as in the ski boot of FIGS. 1–4. The fixed abutment 11 provided on shell base 4 are positioned in front of the vertical edges 12 in order to cooperate with the latter when rear portion 3 of upper 1 is connected to the front portion 2 of the latter with a view to maintaining the lower part of the leg of the skier in the boot in the skiing position.

Figure 6:
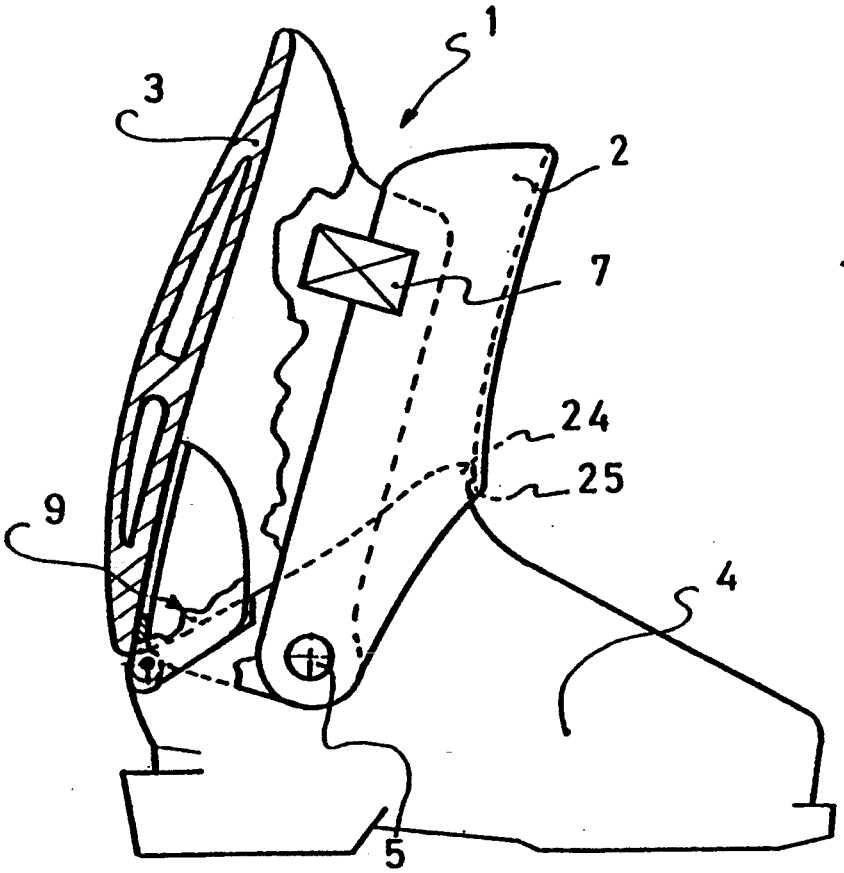
FIGS. 6 and 7 illustrate the adaptation of the control means according to the invention to boots of the mixed entry type, FIG. 6 and top entry type, FIG. 7.
Figure 7:
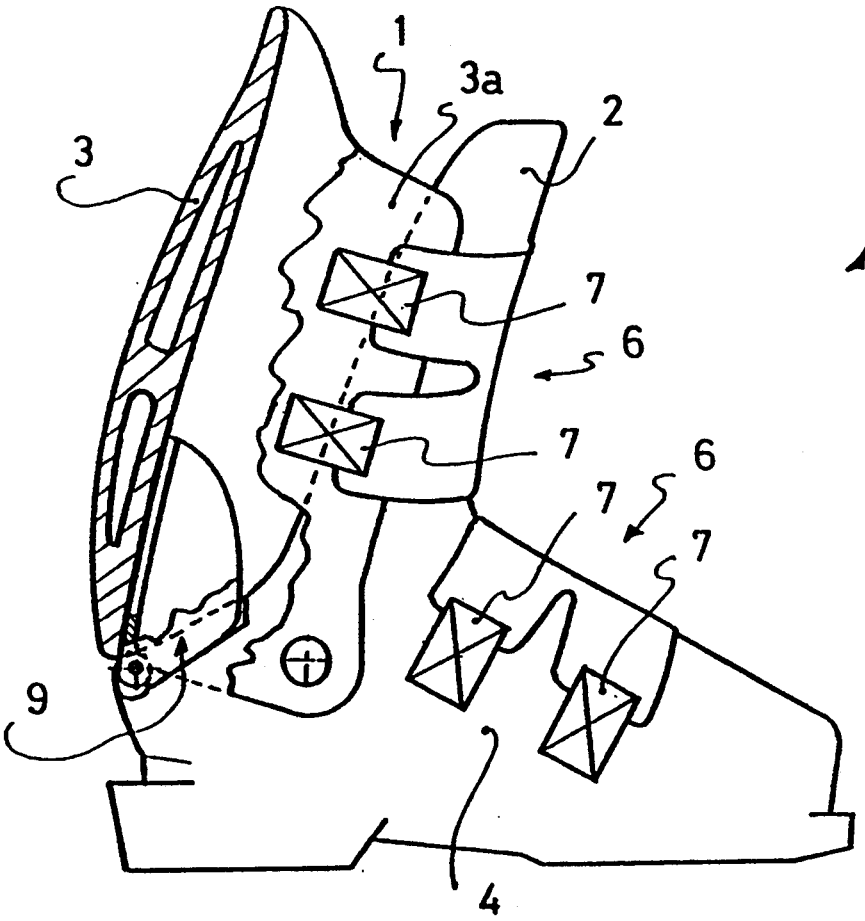

As can be seen in the description mentioned above, the energy flap is, preferably, adapted to boots of the rear entry type. However, in light of its small volume and its easy insertion beneath the rear portion 3 of upper 1 by virtue of its attachment by journal 10 to shell base 4 in the heel zone, such an energy flap 9 may be adapted to boots of the "mixed entry" type such as illustrated in FIG. 6 and to boots of the "top entry" type such as illustrated in FIG. 7. Such boots are widely known and available, and their description will not be provided in their entirety.

In the example of the boot of FIG. 6, the front portion 2 of upper 1 is represented pivoting towards the front with respect to shell base 4 about the same connection axis 5 as that of the rear portion 3. Continuing with this example, the retention towards the rear of upper 1, that is, in a front-to-rear direction is done by means of two edges of abutment 24, 25 obtained respectively on front portion 2 of upper 1 and the upper front edge of shell base 4, substantially in the zone corresponding to the top of the foot. These edges 24 and 25 only cooperate in the front-to-rear direction, the front portion 2 of upper 1 is thus free from a certain bottoming towards the front simultaneously with the rear portion 3 that rocks towards the rear when tensioning element 7 is unlatched for opening the upper 1 for putting on or removal of the boot.

In all these cases of the adaptation of energy flap 9 to ski boots that have been cited and disclosed above, the examples are non-limiting in nature, and flexion control of upper 1 towards the front may be ensured basically by the energy flap 9 and, of course, in association with at least one other flexion control means.

As an example of the boot represented in FIG. 7, the front portion 2 of upper 1 is opened by a longitudinal slot covered by flexible tongues and/or flaps originating from shell base 4 and overlapping each other, and several tightening systems 6 with tensioning elements 7 ensuring closure of the latter in the skiing position by connecting one side of shell base 4 to the other for the lower front portion of the boot and by connecting rear portion 3 and its wings 3*a* with this front portion 2 in the manner of a collar. In this type of boot, the introduction and/or extraction of the foot may be done from the top and from the rear or mainly from the top. It should be noted that retention of upper 1 in the front-to-rear direction is done by means of at least one vertical extension originating from shell base 4 in the front zone of the upper and that this extension is at least flexible in the rear-to-front direction in order to accompany the rear portion 3 when the latter is biased towards the front during flexion. In such a structure of the boot, the frontward flexion control of upper 1 is thus ensured by energy flap 9 together with the flexible vertical extension extending in the front zone of the upper 1.

Figure 8:
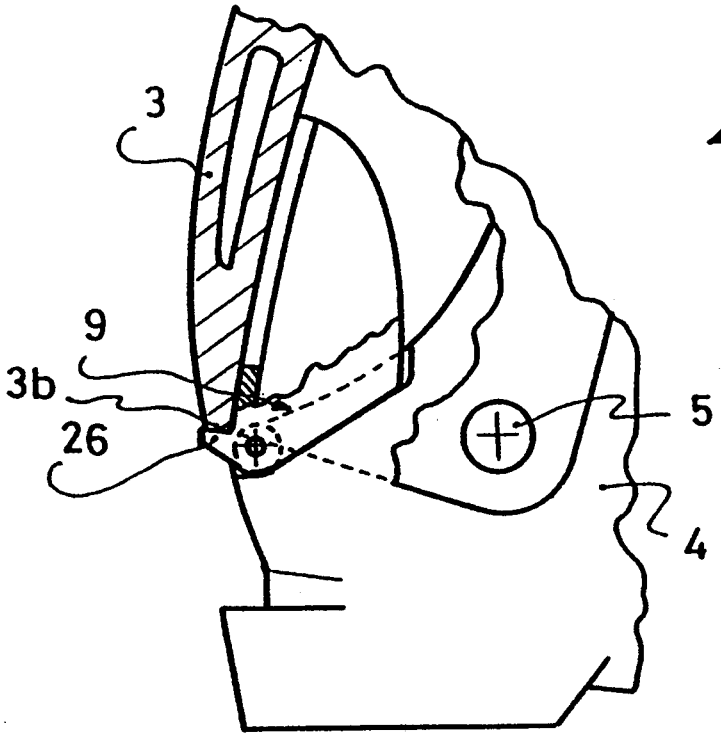
FIG. 8 represents a variation of the embodiment of the control means of the front flexion of the upper.

Also, it is clear from such a construction that upper 1 is relatively flexible towards the rear and that this flexibility may not be desired, especially for competitive skiers who look for a firm rear support. In these cases, one need only provide, as has been illustrated in FIG. 8, energy flap 9 with a support edge 26 adapted to cooperate with at least one portion of the lower zone 3*b* of rear portion 3, thus locked in the skiing position and disabled from any possibility of rocking towards the rear. It is understood that the ski boot is basically used in a "top entry" type of boot unless the support edge 26 is rendered retractable for example in the manner of a "stop ratchet" and this can be done without leaving the spirit of the invention.

The instant application is based upon French patent application 91.03669 of Mar. 21, 1991, the disclosure of which is hereby expressly incorporated by reference thereto, and the priority of which is hereby claimed.

Finally, although the invention has been described with reference of particular means, materials and embodiments, it is to be understood that the invention is not limited to the particulars disclosed and extends to all equivalents within the scope of the claims.

What is claimed is:

1. A ski boot comprising:

a rigid shell base having a heel zone;

an upper;

means for mounting said upper for at least limited pivotal movement about a transverse axis with respect to said shell base to an open position of the boot to enable insertion of a foot of a skier in said open position;

said upper comprising at least one front portion and at least one rear portion, said rear portion of said upper comprising laterally opposed wings;

a closure assembly for closing said upper on the lower leg of a skier, said closure assembly comprising a tightening system at least partially encircling said upper, said tightening system including a tensioning element fixed on at least one of said front portion of said upper and said rear portion of said upper; and a flexion control device, for both flexion amplitude of movement and flexion magnitude of force in a forward direction, said flexion control device comprising:

a flexible flap affixed to said shell base in said heel zone;

said flap extending contiguously beneath said rear portion of said upper, said flap comprising laterally opposed wings extending beneath said laterally opposed wings of said rear portion of said upper, said laterally opposed wings of said rear portion of said upper thereby overlapping said laterally opposed wings of said flap, whereby said rear portion of said upper envelopes said flap and whereby said flap comprises an energy source for said flexion control device; and means for enabling said rear portion of said upper to drive said flap (1) along a free pivotal path in a forward direction generally about a journal axis with respect to said shell base and (2) along a flexion path, said flexion path forwardly following said free pivotal path, wherein said free pivotal path is delimited, at a forwardmost point, by a fixed abutment area of said shell base in cooperation with a complementary movable abutment area of said flap in a closed position of the boot at which said upper is directed against the lower leg of the skier, and wherein said flexion path begins, in said forward direction following said cooperation between said fixed abutment area of said shell base and said movable abutment area of said flap.

2. A ski boot in accordance with claim 1, wherein:

said fixed abutment area of said shell base comprises a projecting edge provided in an upper portion of said shell base;

said movable abutment area of said flap comprises an edge portion of said flap; and said projecting edge of said movable abutment area and said projecting edge of said fixed abutment area comprise complementary surfaces for mutual engagement in said closed position of said boot.

3. A ski boot in accordance with claim 2, wherein:

said projecting edge of said fixed abutment area is located in a heel area of said shell base.

4. A ski boot in accordance with claim 2, wherein:

said movable abutment area of said flap is constituted by lower edges of said flap.

5. A ski boot in accordance with claim 2, wherein:

said movable abutment area of said flap is constituted by upwardly extending edges of said flap.

6. A ski boot in accordance with claim 1, further comprising:

a hinge for enabling pivotal movement of said flap relative to said shell base, said hinge comprising:

a male member unitarily formed with said shell base;

a female member provided in said flap and defined by a pair of lugs; and a pin positioned within said pair of lugs and through said male member.

7. A ski boot in accordance with claim 1, further comprising:

a hinge for enabling pivotal movement of said flap relative to said shell base, said hinge constituted by a flexible element unitarily formed with both said shell base and said flap.

8. A ski boot in accordance with claim 1, wherein:

said flap consists of a unitary piece of plastic material obtained by molding.

9. A ski boot in accordance with claim 1, wherein:

said forwardmost point of said path, in which said movable abutment area of said flap is in engagement with said upper fixed abutment area of said shell base defines a beginning of flexion control of said boot in a forward direction;

said shell base further comprises a lower fixed abutment area spaced beneath said upper fixed abutment area of said shell base by a predetermined distance;

said ski boot further comprises means for enabling said rear portion of said upper to drive said flap pivotally in a rearward direction with respect to said shell base along said path delimited, at a lowermost point, by a lower fixed abutment area of said shell base in cooperation with said movable abutment area of said flap in an open position of the boot; and said predetermined distance defines an angle of maximum opening of said rear portion of said upper for permitting a foot to be inserted into the boot.

10. A ski boot in accordance with claim 9, wherein:

said means for enabling said rear portion of said upper to drive said flap pivotally in a rearward direction comprises:

a rearwardly projecting edge on a lower portion of said flap; and a lower portion of said rear portion of said upper positioned for engagement with said edge of said flap during pivotal movement of said rear portion of said upper in said rearward direction.

11. A ski boot in accordance with claim 1, wherein:

said flap comprises a support edge for engagement with a part of said rear portion of said upper for blocking movement of said flap relative to said upper in a rearward direction.

12. A ski boot comprising:

a rigid shell base having a heel zone;

an upper;

means for mounting said upper for at least limited pivotal movement about a transverse axis with respect to said shell base to an open position of the boot to enable insertion of a foot of a skier in said open position;

said upper comprising at least one front portion and at least one rear portion, said rear portion of said upper comprising laterally opposed wings;

a closure assembly for closing said upper on the lower leg of a skier, said closure assembly comprising a tightening system at least partially encircling said upper, said tightening system including a tensioning element fixed on at least one of said front portion of said upper and said rear portion of said upper; and a flexion control device, for both flexion amplitude of movement and flexion magnitude of force in a forward direction, said flexion control device comprising:

a flexible flap affixed to said shell base in said heel zone;

said flap extending contiguously beneath said rear portion of said upper, said flap comprising laterally opposed wings extending beneath said laterally opposed wings of said rear portion of said upper, said laterally opposed wings of said rear portion of said upper thereby overlapping said laterally opposed wings of said flap, whereby said rear portion of said upper envelopes said flap and whereby said flap comprises an energy source for said flexion control device, said flap comprising a generally vertically elongated slot in a rear portion of said flap, said slot having a pair of generally vertically extending edges, for facilitating flexion as a least respective portions of said vertically extending edges move relative to each other; and means for enabling said rear portion of said upper to drive said flap (1) along a free pivotal path in a forward direction generally about a journal axis with respect to said shell base and (2) along a flexion path, said flexion path forwardly following said free pivotal path, wherein said free pivotal path is delimited, at a forwardmost point, by a fixed abutment area of said shell base in cooperation with a complementary movable abutment area of said flap in a closed position of the boot at which said upper is directed against the lower leg of the skier, and wherein said flexion path begins, in said forward direction following said cooperation between said fixed abutment area of said shell base and said movable abutment area of said flap.

13. A ski boot in accordance with claim 12, wherein:

said vertically elongated slot is an upwardly open slot in a rear portion of said flap, whereby said vertically elongated slot opens to upper edges of said flap.

14. A ski boot in accordance with claim 1, wherein:

said flap comprises an upwardly open slot directed opposite to said journal axis of said flap.

15. A ski boot comprising:

a shell base having a fixed abutment;

an upper;

means for mounting said upper for rearward pivotal movement about a transverse axis with respect to said shell base to an open position of the boot to enable insertion of the foot in said open position, said means for mounting comprising a pair of laterally opposed connection elements, positioned along said transverse axis, for pivotally mounting said upper to laterally opposed sides of said shell base;

said upper comprising at least one front portion and at least one rear portion; and a flexion control device comprising:

a flap positioned between said rear portion of said upper and said shell base, said flap having a movable abutment;

means for enabling said rear portion of said upper to move said flap pivotally about a journal axis in a forward direction with respect to said shell base along a predetermined path to an end of said predetermined path at which said movable abutment of said flap engages said fixed abutment of said shell base; and means for establishing flexion control of said upper for further forward movement beyond said end of said predetermined path, whereby a forward surface of said rear portion of said upper is in contiguous engagement with a rear surface of said flap for permitting forward controlled flexional movement of said rear portion of said upper against said flap as said flap directs a force opposing said forward movement of said upper.

16. A ski boot in accordance with claim 15, wherein:

said movable abutment of said flap is engagement with said fixed abutment of said shell base in a closed position of the boot, whereby in said closed position of the boot, said upper is engaged against the lower leg of a skier.

17. A ski boot in accordance with claim 16, wherein:

said flap comprises a pair of laterally opposite wings, said rear portion of said upper enveloping said flap;

a respective movable abutment is located on a lower portion of each of said wings of said flap, wherein one of said respective movable abutments is said movable abutment of said flap; and a respective fixed abutment is located on laterally opposite sides of said shell base, located for engagement by respective ones of said movable abutments during said forward controlled flexional movement of said rear portion of said upper, wherein one of said respective fixed abutments is said fixed abutment of said shell base.

18. A ski boot in accordance with claim 15, wherein:

at said end of said predetermined path of said flap, said boot is in a closed position; and said predetermined path has an opposite end, wherein at said opposite end of said predetermined path of said flap, said boot is in an openmost position.

* * * * *